United States Patent [19]

Schambre

[11] Patent Number: 4,685,613

[45] Date of Patent: Aug. 11, 1987

[54] RECIPROCABLE TOOL MOUNTING MODULE

[76] Inventor: Frank Schambre, 5713 Smiths Creek Rd., Smith Creek, Mich. 48074

[21] Appl. No.: 908,405

[22] Filed: Sep. 16, 1986

[51] Int. Cl.[4] ..... B26F 1/04

[52] U.S. Cl. ..... 234/131; 234/107; 234/115; 83/571; 83/572

[58] Field of Search ..... 234/107, 131, 115; 83/571, 572

[56] References Cited

U.S. PATENT DOCUMENTS

| | | | |
|---|---|---|---|
| 771,694 | 10/1904 | Barker | 83/687 |
| 1,313,699 | 8/1919 | Kavanagh | 83/571 |
| 1,784,964 | 12/1930 | Jenkins | 137/269 X |
| 2,113,398 | 4/1938 | Dalton | 165/61 X |
| 2,950,737 | 8/1960 | Hendrix | 137/625.48 |
| 3,066,859 | 12/1962 | Darwin et al. | 234/107 |
| 3,073,519 | 1/1963 | Booth | 234/131 X |
| 3,085,594 | 4/1963 | Spragens | 137/625.18 |
| 3,150,517 | 9/1964 | Kuffer et al. | 73/23.1 |
| 3,311,297 | 3/1967 | Williamson et al. | 234/114 |
| 3,659,779 | 5/1972 | Berkman et al. | 234/114 |
| 3,683,735 | 8/1972 | Achler et al. | 83/374 |
| 3,709,082 | 1/1973 | Leska | 83/618 |
| 3,780,939 | 12/1973 | Woodie | 234/115 |
| 3,960,506 | 6/1976 | Schmitzer | 422/135 |
| 4,260,102 | 4/1981 | Thoma | 234/112 |
| 4,555,966 | 12/1985 | Klingel | 83/71 |
| 4,596,359 | 6/1986 | Nordli | 234/107 |

*Primary Examiner*—Donald R. Schran

*Attorney, Agent, or Firm*—Cullen, Sloman, Cantor, Grauer, Scott & Rutherford

[57] ABSTRACT

A module for selectively deploying a reciprocable tool, such as a hole punch, which is reciprocated by a press. The module includes a housing which is attached to the ram of the press. The housing retains a reciprocable tool within a bore for movement between an extended position and a retracted position. The reciprocable tool is connected to the housing by means of a telescopic linkage comprising a cone clutch having resilient fingers that selectively grip a pin. The housing includes a conical surface which engages beveled portions of the resilient fingers holding them in a closed position. A spring biases the cone clutch to its closed or gripping position unless air pressure is supplied to an air chamber which counteracts the biasing force of the spring to open the resilient fingers. When the resilient fingers are open, a shifting means comprising a spring, or alternatively a solenoid, is effective to shift the pin between an extended position and a retracted position within the cone clutch. A controller is disclosed for selectively shifting the reciprocable tool between its extended position and its retracted position within the module wherein a card having air flow control holes corresponding to modules selected for changeover is inserted in the controller.

20 Claims, 6 Drawing Figures

RECIPROCABLE TOOL MOUNTING MODULE

BACKGROUND OF THE INVENTION

1. Technical Field

The present invention relates to a module for mounting a reciprocable tool. More specifically, the invention relates to a mounting module which includes a retraction and extension mechanism permitting selective operation of a reciprocable tool. The mounting module is especially adapted for use in gang punch presses such as those used in the manufacture of trailers or airplanes.

2. Background Art

Reciprocating presses used for punching holes in sheet metal parts, paper, fabric and other objects normally include standardized punches held in punch retainers. The punches are preferably removable for replacement or to permit elimination of a hole punching operation. In gang punch presses used in the manufacture of large parts having a large number of holes, changing hole punch patterns as required for different parts is time consuming. If the changes are not done carefully, misformed parts can result which have too many or not enough holes.

Prior designs for providing retractable punches tend to be bulky and difficult to changeover to different hole punch patterns. Another problem suffered by retractable punches is that they are not sufficiently durable for cutting rigid material such as sheet metal.

An example of one type of prior art multiple punch having selectively operable individual punches is disclosed in U.S. Pat. No. 1,313,699 to Kavanagh. The device used in Kavanagh is commonly referred to as a gagging plate or bar. The gagging plate includes openings which permit a punch to retract into a non-operative position. Portions of the bar between the openings, or raised areas, are provided for supporting a punch and holding it in its operative position. Gagging bars do not permit complete flexibility in hole punch patterns and do not permit the use of quick replacement punches. Care must be used in changing over to eliminate errors in the hole pattern.

Another approach to providing a selectively operable punch is disclosed in U.S. Pat. No. 4,555,966 to Klingel which describes a punch press having a plurality of punches which are selectively shifted between operative and inoperative positions by means of a rotatable cam. The rotatable cam includes a separate drive mechanism and notched and unnotched areas providing inoperative and operative punch positions respectively. The punch mounting arrangement disclosed in Klingel suffers from the disadvantage of requiring considerable radial space between adjacent punches which prevents the use of such apparatus in closely spaced hole patterns. The separate drive mechanism for rotating the rotatable cam is complex and bulky adding excessive expense to the cost of the device.

Another general approach to providing selective punching mechanisms is to provide an interposable element between a punch and the punch drive mechanism. One example of this approach is disclosed in U.S. Pat. No. 3,311,297 to Williamson which describes a selective punching mechanism using a spherical interposer. The interposer is shifted between operative and inoperative positions by energizing a electromagnet which overcomes a permanent magnet provided to bias the interposer into its inoperative position. The device disclosed in Williamson would be inappropriate for use with closely spaced punches due to the space required for the interposer shifting mechanism. Also, the interposer is not well suited for use with quick replacement punches and there is no safeguard against setting improper hole punch patterns. In U.S. Pat. No. 3,659,779 to Berkman a selectively operable punch mechanism is disclosed which uses an interposer comprising a slotted element having cam surfaces for operative and inoperative positions. The slotted elements are shifted to their operative position by means of a pneumatic piston and include a permanent magnet biasing means for holding them in their inoperative position. Both Berkman and Williamson include the use of permanent magnets for biasing the punches in their inoperative position which adds to the cost and complexity of the devices.

The above prior art devices have shown certain shortcomings and disadvantages especially when punching closely spaced holes in relatively rigid materials. Replacement of punches and changeover from one hole pattern to another hole pattern is complicated with prior art devices.

SUMMARY OF THE INVENTION

According to the present invention a module is provided for selectively deploying a reciprocable tool enabling the tool to perform work upon a workpiece when reciprocated by a press. The module includes a housing adapted to be attached to the ram of the press. The reciprocable tool is mounted in the housing for movement relative to the housing. The tool is supported by two telescopic parts which are shiftable between and interlockable in an extended position and a retracted position. The two telescopic parts are relatively shiftable in the same direction that the housing is reciprocated. The first part is urged into engagement with the housing by a biasing means to cause the first part to grip the second part. An operating mechanism is provided for selectively applying a force in opposition to the biasing means whereby the second part is released by the first part. A shifting mechanism is provided to move the second part relative to the first part between the extended position and the retracted position. The telescopic arrangement of the first and second parts is unique in that the first and second parts interlock in the extended position to provide a simple and secure backup for a reciprocable tool. The telescopic arrangement lends itself to providing a module which may be replaced easily and requires only a minimum amount of space radially so that a group of such modules may be located in close radial proximity to each other.

The housing and support preferably further comprises a cylindrical bore formed in the housing for retaining the support. The first telescopic part of the support is a sleeve having a plurality of resilient fingers which extend from one end. The second telescopic part of the support is a pin received within the fingers of the first part. The first part includes an annular locking ring which engages the ends of the fingers to interlock the first part with the second part in the extended position. In this way, the interlock of the ends of the fingers with the annular ring provides a secure positive backup for the punch when the support is in its extended position. The annular locking ring is received between the fingers in the retracted position.

A unique structural aspect of the housing and the fingers of the first telescopic part is that the housing includes a partially conical surface formed within the cylindrical bore and the fingers include partially conical lands which are disposed at a complimentary angle relative to the conical surface formed in the housing. The mating conical surfaces permit the transfer of forces through the punch as it operates upon a workpiece from the ends of the fingers where they are engaged by the annular ring to a broad, angularly disposed conical surface of the housing.

The reciprocable tool is most preferably a punch which is retained in a punch retainer. The punch is attached to a piston which is shiftable within the cylindrical bore of the housing. The cylindrical bore of the housing is closed by an end cap having a guide bore located coaxially with the cylindrical bore through which the punch is axially moved.

The fingers of the first part preferably include two axially spaced grooves which are adapted to receive a guide head formed on the outer surface of the pin. The guide bead is received in one of the ring grooves in the retracted position and the other ring groove in the extended position.

Changing the module from its retracted position to its extended position may be accomplished by the use of various biasing, operator and shifting mechanisms. In the illustrated embodiment a piston is received within a cylindrical bore and is secured to the first telescopic part. A spring acts as the biasing means and operatively connects the housing and the piston and urges the first part into engagement with the housing and causes the first part to grip the second part. The operator means comprises a chamber formed partially by the piston which is selectively placed in fluid communication with a source of pressurized fluid, such as air. The spring biasing means is overcome when the chamber is pressurized and the piston is driven against the biasing means. The first part is forced out of engagement with the housing, releasing the second part. In one of the illustrated embodiments, the shifter means comprises a spring connected to the pin and the sleeve which biases the pin to its extended position relative to the fingers when the operator means causes the fingers to release the pin. If a spring shifter means is used, the pin may be shifted to its retracted position by causing the punch to engage the workpiece while the chamber is pressurized and the fingers have released their grip upon the second part.

In an alternative illustrated embodiment, the shifter means may be a solenoid connected in an electric circuit. The solenoid includes a shiftable element connected to the pin for shifting the pin axially relative to the sleeve.

The operator means may also include a solenoid shiftable between two positions. In one position the solenoid drives the first part out of engagement with the housing and in a second position the solenoid drives the first part into engagement with the housing.

The reciprocable ram of the press in the illustrated embodiment has a gang punch die including a plurality of modules arranged in an array on the die. A gang punch die having a plurality of such modules may include a controller which includes a manifold plate having an air inlet and a plurality of air outlets which are in fluid communication through a plenum. The plenum receives a card having an opening in each location corresponding to the location of an outlet in fluid communication with the module to be changed. The card permits air to flow to the operator means of the selected module and thereby permits the shifter of the module to move the second telescopic part relative to the first telescopic part thereby changing the position of the reciprocable tool. A gang punch having a plurality of modules controlled by such a manifold plate is easy to changeover from one part to another. Further, the cards provide a foolproof method of changing from one part to another wherein the proper selection of hole punch locations is predetermined by the card.

The object of providing a reliable selective punch extension and retraction module is provided by the present invention. The object of providing a module requiring the minimum radial space thereby permitting the formation of closely spaced holes is achieved as a result of the telescopic arrangement of the punch retraction mechanism. The modules are completely independent in operation and no limitations are imposed by the selection mechanism upon the pattern of operations performed on the workpiece. Changeover of the modules is extremely efficient and by the use of the card mechanism errors in setting the operation pattern are reduced. The modules permit the use of standard punches and punch retainers that are easy to replace if a punch breaks.

These and other objects are achieved according to the present invention. The preferred embodiment and one alternative embodiment are shown in the attached drawings and described below in detail.

DETAILED DESCRIPTION OF THE ILLUSTRATED EMBODIMENTS

Figure 1:
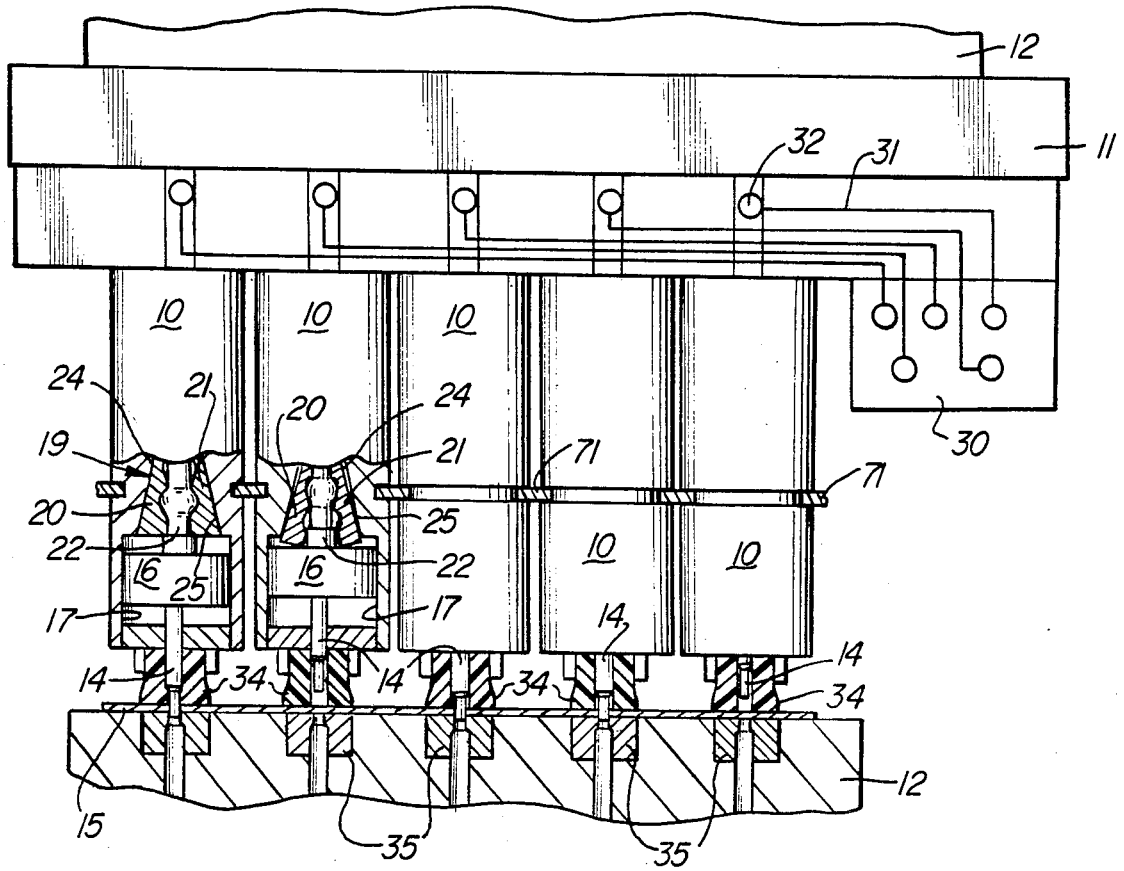
FIG. 1 is an elevational view of a gang punch press partially schematic and partially in fragmentary section showing a series of punch mounting modules in accordance with the present invention.

Referring now to FIG. 1, a series of five punch mounting, or retraction, modules 10 of the present invention are shown disposed in an array on the ram 11 of a gang punch press 12. The module 10 retains a reciprocable tool 14 which performs operations on a workpiece 15. In the illustrated embodiment, the tool 14 is a punch which punches holes in the workpiece. The punch 14 is connected to a piston 16 which is reciprocable in the lower cylindrical bore 17 formed in the module 10 as viewed in FIG. 1. The normal orientation of the module 10 is a vertical orientation with the punch 14 being disposed below the ram 11 of the punch press 12. However, the module 10 of the present invention may be used in any orientation such as a horizontal orientation or an inverted vertical orientation. As used herein, the end of the module 10 through which the reciprocable tool 14, extends will be referred to as the lower end.

A telescopic linkage 19 is provided to interconnect the piston 16 and the punch 14 carried by the piston to the housing 18. The telescopic linkage 19 includes a first part 20 comprising a cone clutch having a plurality of resilient fingers 21 which engage and selectively grip a second part 22 comprising a pin. The second part 22 includes an annular ring 23 which extends radially about the pin 22 to provide a positive interlocking surface which effectively prevents relative axial movement between the first part 20 and the second part 22 in an extended position.

A conical surface 24 is formed at an intermediate location in the housing 18. The conical surface 24 is axially aligned with the small radius portion above the larger radius portion of the conical surface 24. The larger radiused portion of the conical surface 24 opens into the lower cylindrical bore 17 of the housing 18. The resilient fingers 21 of the first part 20, or cone clutch, include beveled portions 25 which are preferably partially conical surfaces that are complimentary in shape to the conical surface 24. The first part 20 grips the second part 22 when the beveled portion 25 of the resilient fingers 21 are urged into contact and against the conical surface 24 of the housing 18. The grip of the first part 20 of the second part 22 is released by shifting the beveled portions 25 out of engagement with the conical surface 24 and permitting the resilient fingers 21 to expand radially outwardly.

As shown schematically in FIG. 1, a control 30 is provided for selectively extending or retracting the reciprocable tool 14 in the module 10. The control 30 is preferably connected to the modules 10 by air lines 31 which terminates in nozzles 32 which are in fluid communication with the modules 10. The control 30 will be described in more detail with reference to FIG. 6 below.

If the reciprocable tool 14 is a punch it will generally include a stripper 34, preferably formed of urethane, which aids in separating the punch from the workpiece after punching a hole. A die button 35 is also preferably provided on the punch press 12 if the reciprocable tool is a punch. The die button 35 supports the workpiece about the area to be punched as is well known in the art.

Figure 2:
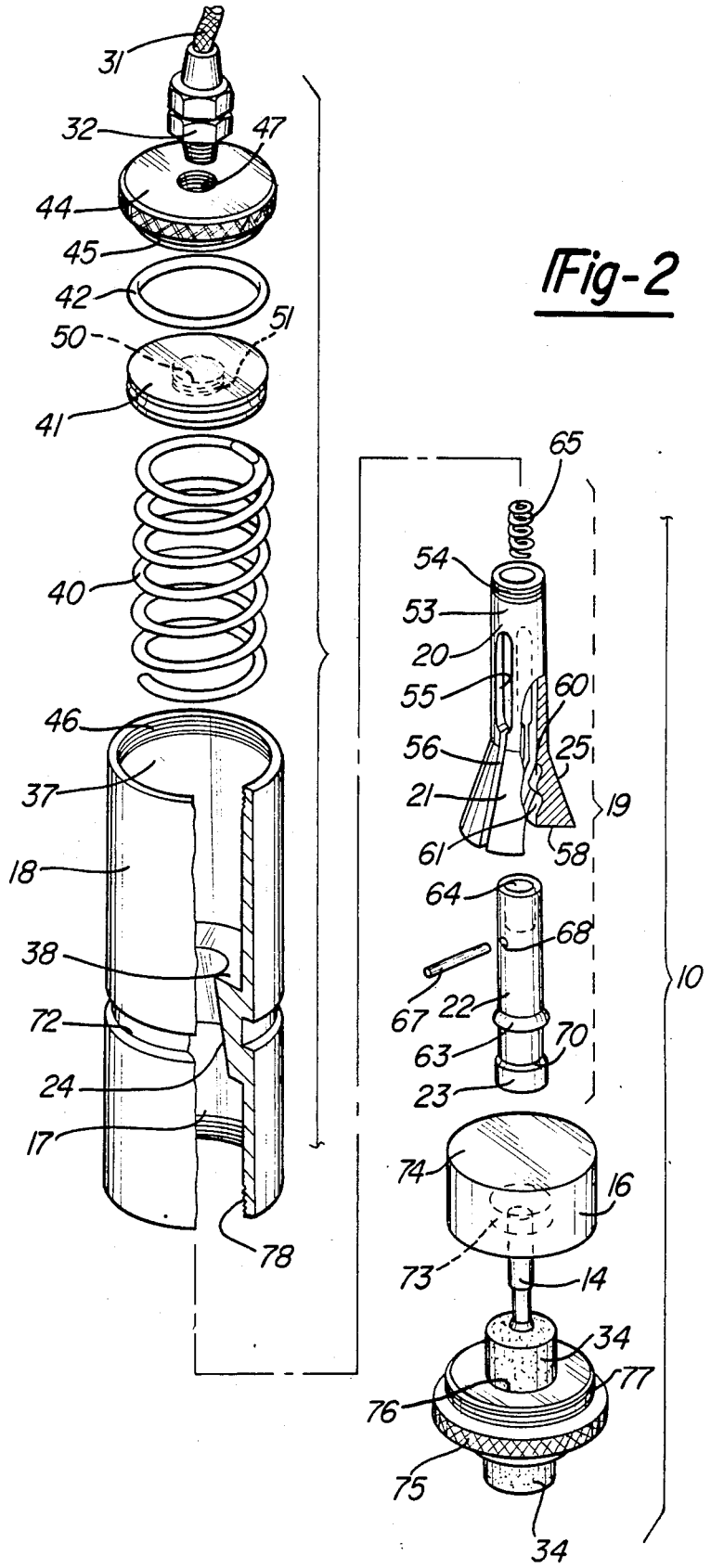
FIG. 2 is a exploded perspective view of a punch mounting module of the present invention.
Figure 3:
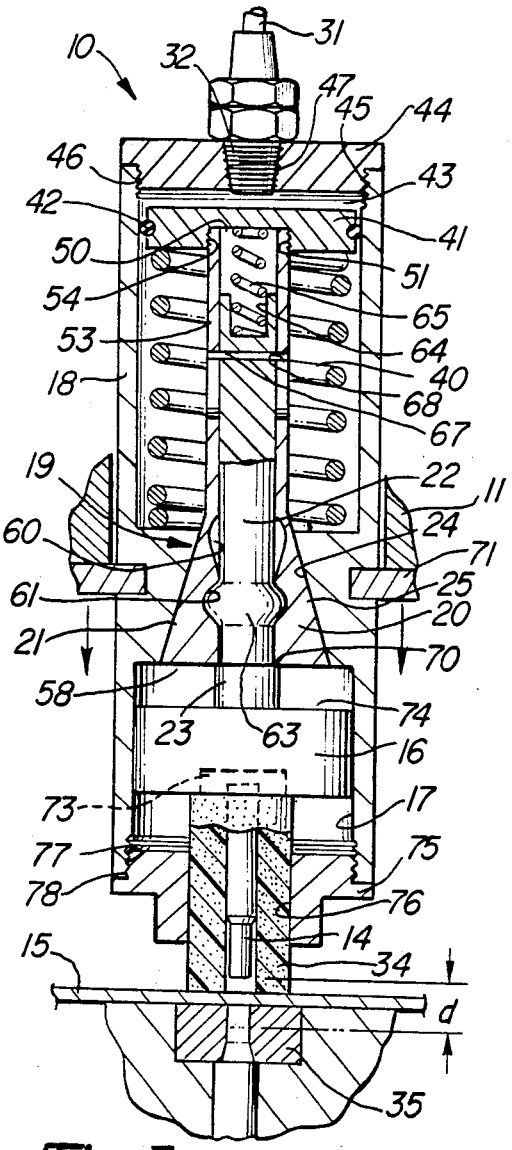
FIG. 3 is a cross-sectional view of the punch mounting module of the present invention in its extended position.
Figure 4:
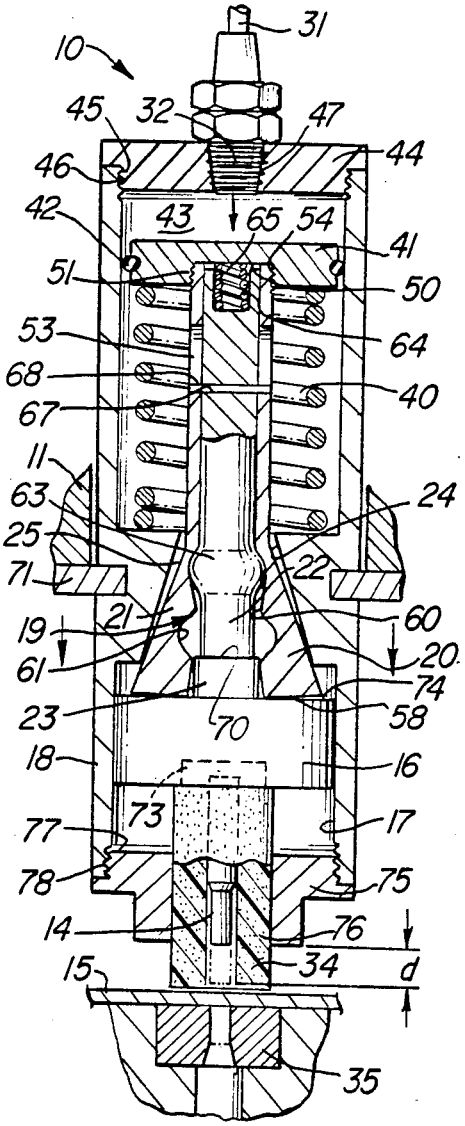
FIG. 4 is a cross-sectional view of the punch mounting module in its retracted position.

Referring now to FIGS. 2, 3 and 4, the parts of the module will be described in detail and their cooperation to achieve the objectives of the invention as previously will be explained in detail. An upper cylindrical bore 37 is formed in the housing 18 to extend from a point radially aligned with the upper end of the conical surface 24 to the upper end of the housing 18. A shoulder 38 forms the juncture between the conical surface 24 and the upper cylindrical bore 37.

A coil spring 40 in the illustrated embodiment is disposed in the upper cylindrical bore 37 to exert a biasing force against a piston 41. The piston 41 preferably includes an O-ring seal 42 which establishes a seal between the piston 41 and the walls of the cylindrical bore 37. An air chamber 43 is preferably defined by the piston 41 and the cylindrical bore 37 on the upper end of the housing 18. An end cap 44 is provided to close the upper end of the housing 18 which completes the air chamber 43, as best shown in FIG. 3 and 4. The end cap 44 has a male threaded portion 45 which is received in a female threaded portion formed on the upper end of the housing 18. The end cap 44 has an air inlet opening 47 in which a nozzle 32 is received to place the air chamber 43 in fluid communication with a source of pressurized fluid such as compressed air.

A recess 50 is formed in the lower face of the piston 41. The recess 50 has threaded walls 51 by which the piston is interconnected to the first part, or cone clutch 20. The cone clutch 20 includes a sleeve portion 53 comprising a generally tubular end of the cone clutch having external, or male, threads 54 which are adapted to be interconnected with the threaded walls 51 of the recess 50 in the piston 41. A plurality of elongate slots 55 are formed in the sleeve portion 53 to make the sleeve portion resiliently deformable. Elongate slots 55 are aligned with and form part of linear spaces 56 between adjacent resilient fingers 21. The linear spaces 56 extend from the elongate slots 55 to the ends 58 of the fingers 21. The linear spaces 56 permit the fingers 21 to be compressed or spread as required to grip or release the second part, or pin 22.

The fingers 21 include on their inner surfaces a retract ring groove 60 and an extend ring groove 61 which are engaged by a guide bead 63 formed on the pin 22 at a location spaced from the annular ring 23. The guide bead 63 is received in the retract ring groove 60 when the punch is retracted and is received in the extend ring groove 61 when the punch is extended.

The pin 22 includes a blind bore 64 on its upper end which faces the lower end of the piston 16. A spring 65 functions to shift the pin 22 relative to the cone clutch 20. The spring 65 is disposed in the blind bore 64 and engages the piston 41. The spring 65 is an annular coil spring which exerts a biasing force upon the pin urging the pin into the extended position wherein the guide bead 63 engages the extend ring groove 61. When the beveled portions 25 of the resilient fingers 21 are in full engagement with the conical surface 24 the fingers grip the guide bead 63 and prevent the spring 65 from shifting the pin. When the air chamber 43 is pressurized the piston 41 moves downwardly causing the resilient fingers 21 to expand as the beveled portions 25 of the fingers 21 disengage the conical surface 24. When disengaged, the spring 65 can shift the pin from the position wherein the guide bead 63 is disposed in the retract ring groove 60 to the position where it is disposed in the extend ring groove 61.

Returning the punch 14 to its retracted position may be accomplished by cycling the press to its down position while the air chamber 43 is pressurized and the beveled portions 25 of the resilient fingers 21 are out of engagement with the concical surface 24. The punch 14 is driven into engagement with a workpiece 15 while the resilient fingers 21 are not gripping the pin 22 forcing the pin to be driven back up into the cone clutch 20 until the guide bead 63 engages the retract ring groove 60.

A roll pin 67 is received in an aperture 68 formed transversely through the pin 22. The roll pin 67 extends radially outwardly from opposite sides of the pin 22 and is received in the elongated slots 55 formed in the cone clutch 20. The elongated slots guide the shifting movement of the pin 22 within the cone clutch 20.

The annular ring 23 has a slightly greater radial extent than the pin 22 and a shoulder 70 is formed at the juncture of the pin 22 and the annular ring 23. The shoulder 70 preferably extends radially from the sides of the pin 22. The shoulder 70 is provided to engage the ends 58 of the fingers 51 when the telescopic linkage 19 is in its extended position as shown in FIG. 3. The ends 58 of the fingers 21 are parallel to the shoulder 70 and firmly engage the shoulder 70 during a punching operation. Forces received through the punch 14 during a punching operation are transmitted through the piston 16 to the annular ring 23. The annular ring 23 in turn transmits the forces through the shoulder 70 to the ends 58 of the fingers 21. The fingers 21 are supported in the extended position by the conical surface 24 and forces resulting from the punching operation are transmitted through the beveled portions 25 of the fingers 21 to the conical surface 24 of the housing. The housing 18 is connected to the ram 11 of the punch press 12 by means of mechanical clamp 71 which engage in an annular groove 72 formed in the exterior of the housing 18.

A punch retainer 73 is preferably recessed within the piston 16. The punch retainer is preferably a ball detent type punch retainer which allows quick replacement of a punch.

The piston 16 has an upper face 74 which is held in abutment with the end of the pin 22 adjacent the annular ring 23.

The housing 18 is closed on its lower end by a end cap 75 which includes an axially extending bore 76 that is coaxial with the cylindrical bore 17. The punch 14 is received in and extends through the coaxial bore 76. The lower end cap 75 with its coaxial bore 76 acts as a guide which keeps the punch in alignment. The end cap 75 includes a male threaded portion 77 which is received in the female threaded portion 78 formed on the lower end of the housing 18.

Figure 5:
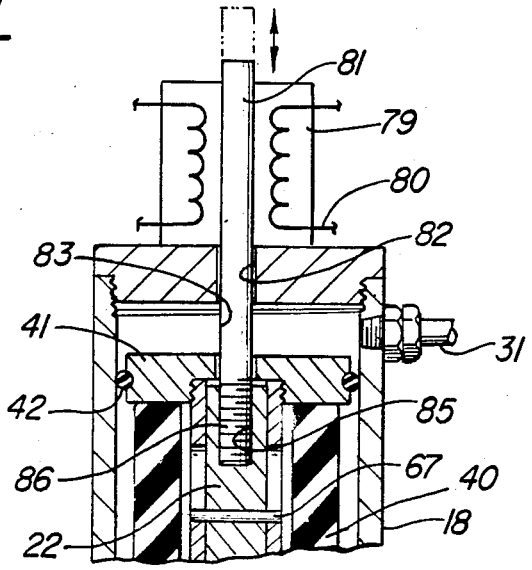
FIG. 5 is a fragmentary cross-sectional view showing an electrical shift apparatus in accordance with an alternative embodiment of the present invention.

Referring now to FIG. 5, an alternative embodiment of the present invention is shown wherein a solenoid 79 is used in place of the spring 65 to perform the function of shifting the cone clutch 20 and pin 22 relative to one another. The solenoid 79 offers the advantage of providing positive, electrically controlled shifting of the cone clutch 20 and the pin 22. This positive shifting action permits the change over of a punch between the extend and retracted positions without cycling the press 12.

The solenoid 79 is connected in an electrical control circuit by wires 80. The solenoid 79 includes a shiftable member 81 which is received through a coaxial opening 82 in the end cap 44 and through a central opening 83 in the piston 41. The shiftable member 81 has a threaded end 85 which is received in a threaded bore 86 formed in the upper end of the pin 22. The solenoid 79 shifts the shiftable member 81 between extended and retracted positions which in turn shifts the pin 22 within the cone clutch 20. The biasing force of the spring 40 against the piston 41 holds the beveled portions 25 of the resilient fingers 21 in engagement with the conical surface 24 of the housing 18 unless the air chamber 43 is pressurized to overcome the biasing force of the spring 40. The arrangment of the resilient fingers 21 relative to the housing 18 causes forces exerted upon the ends 58 of the fingers 21 to be transmitted through the beveled portion 25 and to the conical surface 24 of the housing 18. This unique arrangement permits a solenoid to be coaxially aligned with the punch 14 without being required to withstand the forces transmitted through the punch during a hole punching operation on a workpiece 15.

Figure 6:
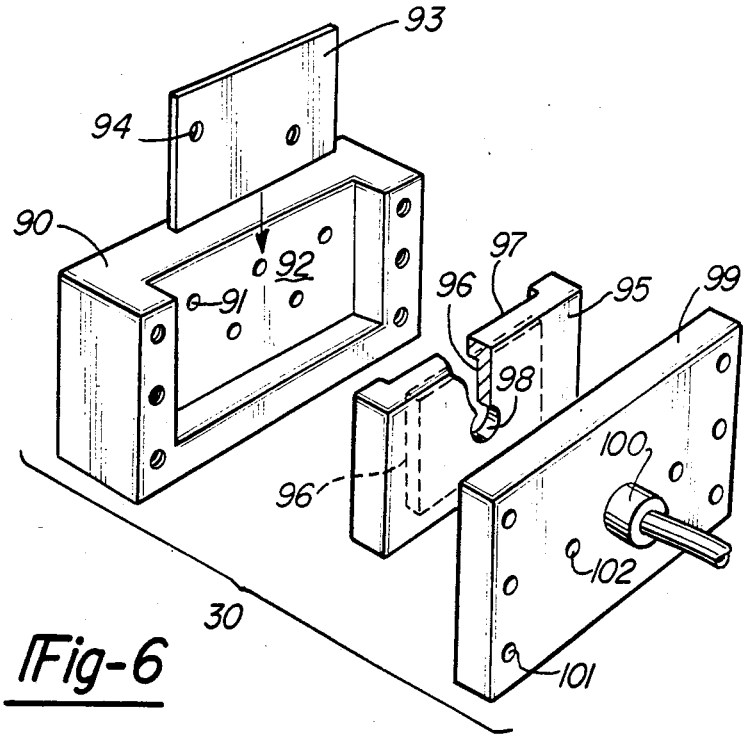
FIG. 6 is an exploded perspective view of a pneumatic card control for selectively shifting the modules of the present invention.

Referring now to FIG. 6, the preferred control 30 will be described in detail. The control 30 includes an outlet manifold plate 90 which includes a plurality of apertures 91 that are in fluid communication with the air lines 31 and nozzles 32 described above. The outlet manifold plate 90 has a recess 92 into which the apertures 91 open. A card 93 is adapted to be inserted in the recess 92. The card 93 includes air flow control holes 94 corresponding to the modules 10 selected to be changed in orientation from an extended punching position to a retract punching position, or vice versa.

A plenum plate 95 is adapted to be received in the recess 92 formed in the outlet manifold plate 90. The plenum plate 95 includes a recess 96 which acts as a plenum in which the card 93 is received. A card slot 97 may be provided on the upper end of the plenum plate 95 as shown in FIG. 6 to provide access to the card 93. An inlet opening 98 is formed in the plenum plate 95 so that pressurized air may be injected into the recess 96 of the plenum plate 95 and in turn supplied to the nozzles 32 through the air lines 31, apertures 91 and air flow control holes 94.

A clamping plate 99 is attached to the outlet manifold plate 90 to hold the plenum plate 95 in place. The clamping plate 99 includes a nozzle 100 which is connected to the air supply and places the recess 96 in fluid communication with the air supply through the inlet opening 98. A plurality of fastener bores 101 are provided in the outlet manifold plate 90 and clamping plate 99 in corresponding locations to receive fasteners as is well known in the art. The clamping plate 99 also includes jack screw bores 102 through which fasteners are received to bear upon the plenum plate 95 to urge the plenum plate into sealing engagement with the manifold plate 90.

The illustrated control 30 is preferred since a predetermined pattern of holes may be incorporated on a card 93 so that a plurality of changes may be automatically coordinated for a part through which the card 93 is dedicated. It should be understood that individual air valves could be used to control the pressurization of the air chamber 43.

Likewise, an electrical control including a solenoid for shifting the piston 41 could be substituted for the spring 40 and air chamber 43 without departing from spirit and scope of the invention.

In the illustrated embodiments the punch and housing are cylindrical members, however, it should be appreciated that the housing 18, lower bore 17, and upper bore 37 could be non-cylindrical in shape if desired. The cone clutch and pin could likewise be non-cylindrical, such as elliptical or polygonal in transverse cross-section.

The springs 40 and 65 in the illustrated embodiment are coil springs, however, it will be readily appreciated by one skilled in the art that urethane spring elements could be substituted.

The preferred material for the housing and component parts of the module is steel. In particular the cone clutch is preferably formed of 6150 steel for greater resiliency. The fingers are preferably heat treated to bias them into an open position as is well known in the art. It is anticipated that the cone clutch 20 could be fabricated from plastic with metallic inserts for backing up the annular ring 23 and transmitting forces through to the beveled portion 25 of the resilient fingers 21. The reason that the cone clutch can be fabricated from plastic is that the length of the cone clutch does not support the loads transmitted from the punch during the punching operation.

The module 10 has been described in the context of a punch operation, however, it should be appreciated that a reciprocable tool could be a tool used in a rivetting, swaging, stamping or forming operation. The applications for such modules include any manufacturing operation wherein a plurality of holes are formed in different patterns, especially where the holes or operations must be performed in close proximity to one another. The potential applications for the module include air craft manufacturing, truck manufacturing, paper punching, and manufacturing electronic components.

What is claimed is:

1. A module for selectively deploying a reciprocable tool to selectively enable the tool to perform work upon a workpiece when reciprocated by a ram of a press comprising:

a housing attached to the ram of the press;

a reciprocable tool mounted for movement axially relative to the housing;

a telescopic linkage retained in the housing having first and second telescopic parts which interconnect the housing to the tool and are shiftable between and interlockable in an extended position and a retracted position, said telescopic parts being relatively shiftable axially in the direction the housing is reciprocated;

biasing means for urging the first part into engagement with the housing and for gripping the second part;

operator means for selectively applying a force on the first part in opposition to the urging of the biasing means and for releasing the second part; and shifter means for moving the second part relative to the first part.

2. The module of claim 1, wherein said reciprocable housing has a cylindrical bore in which said telescopic linkage is retained, said first telescopic part of the telescopic linkage being formed as a sleeve with a plurality of resilient fingers extending from one end, said second telescopic part of the telescopic linkage being a pin received within the fingers of the first part and having an annular locking ring which engages the ends of the fingers to interlock the first part with the second part in the extended position, said annular ring being received within the fingers in the retracted position.

3. The module of claim 2, wherein said reciprocable tool is a punch and which is received in a punch retainer attached to a piston which is shiftable within the cylindrical bore of the housing, an end cap being secured to the cylindrical bore, said end cap having a guide bore coaxial with the cylindrical bore, said punch being received within the guide bore for axial movement.

4. The module of claim 2, wherein said housing includes a partially conical surface formed in the cylindrical bore, and said fingers include conical lands disposed at a complimentary angle relative to the conical surface formed in the housing.

5. The module of claim 4, wherein said fingers are formed with two ring grooves on their innersurface which are spaced axially, and said pin includes a guide bead on its outer surface which is adapted to be received within one of said ring grooves in the retracted position and the other of said ring grooves in the extended position.

6. The module of claim 1, wherein a piston is secured to said first part, said housing includes a cylindrical bore in which the piston is received and said biasing means comprises a spring operatively connected between the housing and the piston, and said operator means comprises a chamber which may selectively be placed in fluid communication with a source of pressurized fluid said piston forming one wall of the chamber.

7. The module of claim 6, wherein said shifter means comprises a spring connected to said pin and operatively connected to said sleeve.

8. The module of claim 6, wherein said shifter means comprises a solenoid connected in an electric circuit and having a shiftable element connected to said pin for shifting the pin axially relative to the sleeve.

9. The module of claim 1, wherein said biasing means comprises a solenoid connected in an electrical circuit and having a shiftable element connected to the first telescopic part which is effective to urge the first part into engagement with the housing and said operator means comprises said solenoid in its electrically reversed state wherein the first telescopic part is urged out of engagement with the housing.

10. The module of claim 1, wherein said ram is a gang punch die having a plurality of modules arrayed on the die.

11. The module of claim 10, wherein said operator means is controlled by a manifold plate having an air inlet and a plurality of air outlets which are in fluid communication with a plenum, said plenum being adapted to receive a card having at least one opening in a location corresponding to the location of at least one of said outlets wherein provision of an opening on said card permits air flow to the operator means and permits the shifter means to move the second telescopic part relative to the first telescopic part and change the position of said reciprocable tool.

12. A module for selectively shifting a tool between an operative position and an inoperative position comprising:

a housing having an elongated opening with a partially conical portion;

a cone clutch having a plurality of resilient fingers on one end extending from a unitary portion, said fingers having outer surfaces which are conical segments which are disposed at an angle complimentary to the conical portion of the housing and end surfaces extending radially inwardly from the outer surfaces toward a central axially extending opening;

a pin shiftably disposed in the central opening in the cone clutch for movement between an extended position wherein the annular locking lip engages the ends of the fingers and the outer surfaces of the fingers are in face to face contact with the conical portion of the housing, and a retracted position wherein the annular locking lip is disposed in the central opening and the cone clutch is shifted axially with the outer surfaces of the fingers flexed radially outwardly;

a retainer connected to the pin;

a tool retained by the retainer and shifted between an extended position and a retracted position;

biasing means for urging the cone clutch into engagement with the housing causing the cone clutch to grip the pin;

operator means for selectively applying a force on the cone clutch in opposition to the urging of the biasing means causing the cone clutch to release the pin; and shifter means for moving the pin relative to the cone clutch.

13. The module of claim 12, wherein said tool is a punch and the retainer is attached to a piston is shiftable within the elongated opening of the housing, an end cap being secured to the elongated opening, said end cap having a guide bore coaxial with the elongated opening, and said punch being received within the guide bore for axial movement.

14. The module of claim 12, wherein said fingers are formed with two ring grooves on their innersurface which are spaced axially, and said pin includes a guide bead on its outer surface which is adapted to be received within one of said ring grooves in the retracted position and the other of said ring grooves in the extended position.

15. The module of claim 12, wherein a piston is secured to said cone clutch, said elongated opening in said housing is a cylindrical bore in which the piston is received and said biasing means comprises a spring operatively connected between the housing and the piston, and said operator means comprises a chamber which is selectively placed in fluid communication with a source of pressurized fluid and said piston forms one wall of the chamber.

16. The module of claim 12, wherein said shifter means comprises a spring interconnecting said pin and said cone clutch.

17. The module of claim 12, wherein said shifter means comprises a solenoid connected in an electric circuit and having a shiftable element connected to said pin for shifting the pin axially relative to the cone clutch.

18. The module of claim 12, wherein said biasing means comprises a solenoid connected in an electrical circuit and having a shiftable element connected to the cone clutch which is effective to urge the cone clutch into engagement with the housing and said operator means comprises said solenoid in its electrically reversed state wherein the cone clutch is urged out of engagement with the housing.

19. The module of claim 12, wherein said operator means is controlled by a manifold plate having an air inlet and a plurality of air outlets adapted to be connected to the corresponding plurality of modules and which are in fluid communication with a plenum, said plenum being adapted to receive a card having at least one opening in a location corresponding to the location of at least one of said outlets wherein by providing of an opening on said card corresponding to said operator means air is permitted to flow to the operator means and allowing the shifter means to move the pin part relative to the cone clutch and change the position of said reciprocable tool.

20. A retraction module for a reciprocating tool comprising:

an elongated housing having two ends, a first cylindrical bore extending inwardly from the first end of the housing, a second cylindrical bore extending inwardly from the second end of the housing and being coaxial with the first cylindrical bore, a tapered partially conical opening disposed coaxially with and extending between said first and second bores;

a reciprocable tool having a work engaging end and a retained end;

a tool retainer connected to the retained end of the tool;

a first piston shiftably received in the first bore of the housing and being connected to the tool retainer;

an end cap connected to the first end of the housing and engaging said tool at a spaced location from the first piston for guiding the movement of said tool through the first end;

a retractable pin having a first end which engages the first piston;

a cone clutch having a plurality of resilient fingers extending from a unitary tubular portion, the fingers having a beveled portion on their outer surface corresponding in contour to the partially conical opening, a central axially extending opening formed in the cone clutch by the inner surface of the fingers, said retractable pin being slidably received in the central axially extending opening for locking the pin in and moving the pin between an extended position in which the pin extends out of the fingers and a retracted position in which the pin does not extend out of the fingers;

a second piston secured to the unitary tubular portion of the cone clutch and being received in the second cylindrical bore formed in the housing;

a first biasing means connected between the retractable pin and a second piston for shifting the pin longitudinally relative to the cone clutch;

second biasing means connected between the housing and the second piston for urging the second piston and the beveled portion of the cone clutch fingers into engagement with the conical opening in the housing;

third biasing means operatively connected between the second piston and the housing for shifting the cone clutch fingers axially away from the conical opening in the housing, permitting the fingers to move radially outwardly from the pin thereby unlocking the pin and permitting the first biasing means to shift the pin axially within the central axially extending bore in the cone clutch.

* * * * *